US005172428A

United States Patent [19]

Leinoff

[11] Patent Number: 5,172,428

[45] Date of Patent: Dec. 22, 1992

[54] CONVERTIBLE FUR PIECE

[76] Inventor: David Leinoff, 71 Park Ave., New York, N.Y. 10016

[21] Appl. No.: 838,962

[22] Filed: Feb. 21, 1992

[51] Int. Cl.[5] ..... A41D 5/00

[52] U.S. Cl. ..... 2/181; 2/336; 2/338; 2/65; 2/DIG. 11; 224/264; 224/907

[58] Field of Search ..... 2/181, 181.2, 336, 338, 2/DIG. 11, DIG. 6, 65; 224/264, 907

[56] References Cited

U.S. PATENT DOCUMENTS

| | | | |
|---|---|---|---|
| Re. 33,430 | 11/1990 | Reaver | 2/181 |
| D. 273,341 | 4/1984 | Rol | D2/344 |
| 1,631,694 | 6/1927 | Rick | 224/264 |
| 2,676,737 | 4/1954 | Zirbel | 224/264 |
| 3,466,663 | 9/1969 | Mehl | 2/65 |
| 3,479,667 | 11/1969 | Mehl | 2/65 |
| 3,509,580 | 5/1970 | Rubenstein | 2/65 |
| 4,277,847 | 7/1981 | Florio | 2/171 |
| 4,468,817 | 9/1984 | Nunnery et al. | 2/181 |
| 4,575,874 | 3/1986 | Johnson | 2/268 |
| 4,612,935 | 9/1986 | Greifer | 2/268 |
| 4,704,745 | 11/1987 | Reaver | 2/268 |
| 4,764,988 | 8/1988 | Reaver | 2/268 |

*Primary Examiner*—Werner H. Schroeder
*Assistant Examiner*—Gloria Hale
*Attorney, Agent, or Firm*—Fitzpatrick, Cella, Harper & Scinto

[57] ABSTRACT

A convertible fur piece is disclosed which consists of an elongated strip of fur having hook and loop connecting strips secured to its opposed longitudinal edges which enable the strip of fur to be folded in half with its edges secured together to form an elongated hollow tube which receives a shoulder bag strap, or the like, to form a decorative element for the shoulder bag strap and a protective guard to reduce wear resulting from rubbing of the shoulder bag strap against the fur coat. Additionally, the ends of the fur strip have additional hook and loop connecting strips respectively secured thereto enable the fur strip to also serve as a head band.

16 Claims, 2 Drawing Sheets

CONVERTIBLE FUR PIECE

The present invention relates to a multi-purpose fur strip, and in particular to a fur strip which is adapted to be used either as a head band or as a guard for a shoulder bag strap.

Wearers of fur coats have found that when a conventional shoulder bag is used with a fur coat, the shoulder bag strap tends to compress and even wear the fur on the coat at the shoulder. Given the expense of fur coats, this is undesirable. Therefore, women often forego the use of shoulder strap handbags when wearing fur coats. This problem is overcome by the present invention, as described hereinafter, which provides a fur strip adapted to surround the shoulder bag strap to protect the fur of the fur coat.

In recent years it has also become a fashion trend for women to wear a fur head band with their fur coat. Preferably, the fur of the head band matches the fur of the fur coat. These bands are formed of a single strip of fur with connecting means such as hook and loop strips or hooks and eyes at the ends of the fur band to secure them together. These existing fur bands are single-purpose items, which are only used as fur bands.

It is an object of the present invention to provide a convertible fur strip which is adapted to be used both as a shoulder strap guard and, alternatively, as a head band.

Another object of the present invention is to provide a head band arrangement which can be used as a guard for a shoulder bag strap when not in use as a head band.

A further object of the present invention is to provide a convertible fur piece which is relatively simple and inexpensive to manufacture.

Yet another object of the present invention is to provide a fur piece which can serve as a fashion element while having multiple uses.

In accordance with an aspect of the present invention, a convertible fur piece is provided which consists of an elongated strip of fur that has a fur side and a leather side. The fur strip has a pair of longitudinally extending edge portions and a pair of opposed end portions. Hook and loop strips, of the type sold under the trademark VELCRO, are respectively secured to the elongated edge portions of the fur strip. These connecting strips permit the fur strip to be folded over upon itself so that the longitudinal edges thereof are secured together by the hook and loop strips. This forms an elongated fur tube which is adapted to receive the strap of a handbag or the like. The resulting fur tube serves as a decorative element for the strap of the handbag and also serves to protect fur coats, with which the handbag is worn, against unnecessary wear at the shoulder by the shoulder strap. Additionally, the fur strip has sections of the loop and hook strips secured to its end portion so that in the unfolded position the fur band can be placed about the head and the ends secured together to form a head band as a fashion element.

The above, and other objects, features and advantages of this invention will be apparent in the following detailed description of an illustrative embodiment thereof, which is to be read in connection with the accompanying drawings, wherein.

Figure 1:
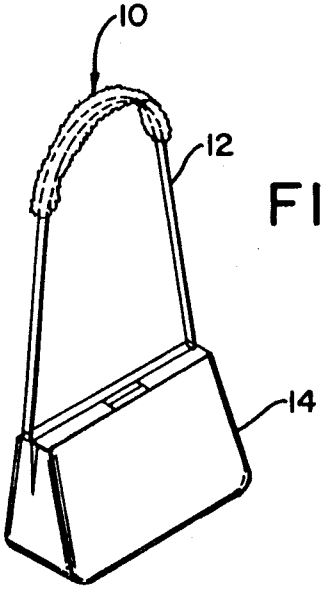
FIG. 1 is a perspective view of a handbag having the convertible fur piece of the present invention secured to the strap.
Figure 7:
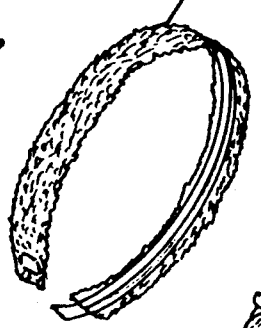
FIG. 7 is a perspective view of the fur strip of the present invention arranged to form a head band.
Figure 8:
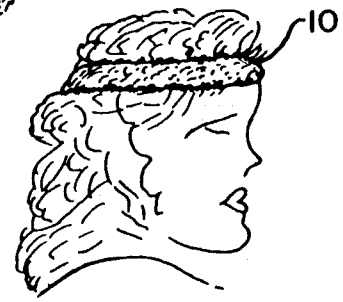
FIG. 8 is a perspective view showing the head band in use.

Referring now to the drawing in detail and initially to FIG. 1, a convertible fur strip 10, constructed in accordance with the present invention, is illustrated in its configuration defining a fur tube adapted to surround the strap 12 of a handbag 14, or the like. The fur tube in this configuration serves as a decorative element for the handbag which can be used, per se. but preferably is used when the wearer is wearing a fur coat, since the fur strip matches the fur coat and serves to prevent wear on the shoulder of the coat which would otherwise be caused by direct contact between the fur coat and the leather strip of the handbag. The fur strip 10 can be arranged in a second configuration, illustrated in FIG. 7, wherein it is adapted to be worn as a head band, as illustrated in FIG. 8.

Figure 2:
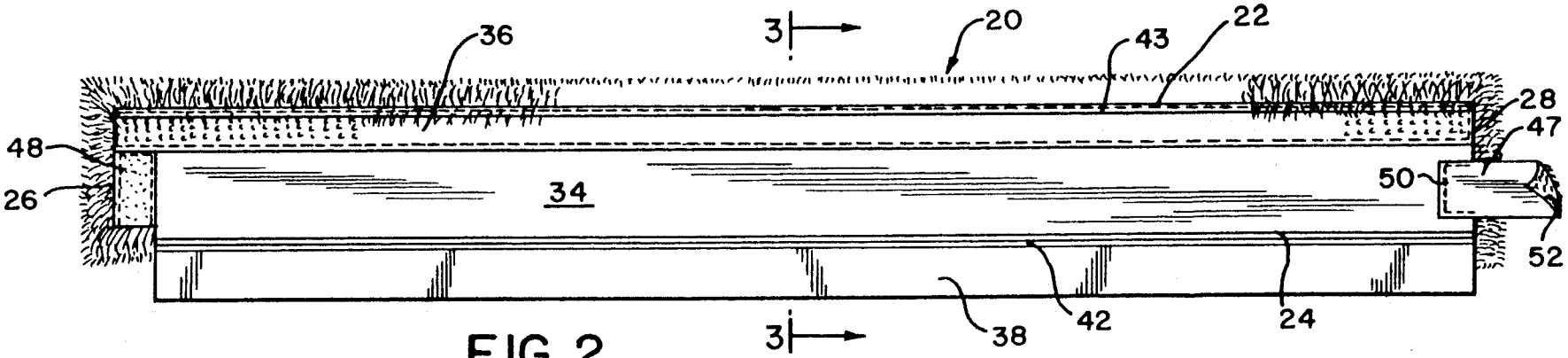
FIG. 2 is a rear plan view of the convertible fur strip constructed in accordance with the present invention.

The convertible fur piece 10 of the present invention consists of a generally elongated rectangular strip of fur 20, as illustrated in FIG. 2. The fur strip may be of mink or any other fur typically used to make fur coats, i.e., fox, beaver, or raccoon. The fur strip has elongated longitudinal edge portions 22, 24, respectively, as well as shorter end portions or edges 26, 28. The fur strip has a fur side 30 (see FIG. 3) and a leather side (32). Preferable a fabric backing strip 34 is secured to the leather side of the fur strip by an adhesive, as will be apparent to those skilled in the art. Alternatively, the backing strip can be sewn to the longitudinal edges of the fur strip. The backing strip is formed of any known fabric suitable for use as a liner in fur coats. For convenience of illustration it is shown only in FIG. 3.

Figure 3:
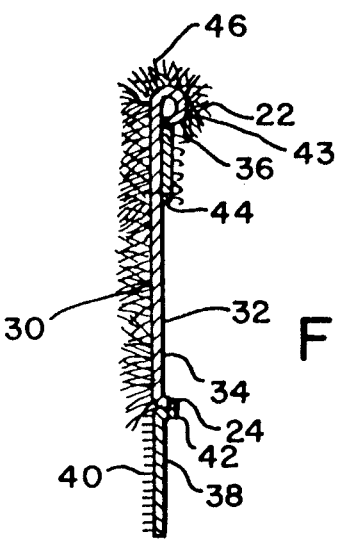
FIG. 3 is a sectional view, taken along lines 3—3 of FIG. 2, showing the components of the convertible fur strip of the present invention, as sewn together.

A set of hook and loop connecting strips are secured to the fur strip, as illustrated in FIG. 3. These loop and hook fur strips are of the kind which are well known and sold publicly under the trademark VELCRO. These fur strips generally are formed of a fabric material, and one of the strips 36 has loops formed on one side thereof while the other strip 38 has hooks 40 formed thereon in the known manner.

In accordance with the present invention, the loop strip 38 has its inner longitudinal edge 42 positioned along the longitudinal edge 24 of the fur strip, and blind-stitched thereto, in the configuration illustrated in FIG. 3. Blind-stitching of fabric to fur in this way is a known technique, but not heretofore used to form convertible fur pieces which convert from tubes to head bands as described hereinafter. The loop strip is sewn to the fur strip with the loops facing initially in the same direction as the fur, as seen in FIG. 3.

The hook strip 36 is secured to the longitudinal edge 2 of the fur strip in the same manner by having its longitudinal edge 43 blind-stitched to the edge 20, again as seen in FIG. 3. The hook strip is secured to the fur strip initially with the hooks facing in the same direction as the fur. After the initial blind stitch seam is formed between the edges 22, 43, the hook strip is folded back over the fabric strip 34, into the position shown in FIG. 3, and the longitudinal edge 44 of the hook strip is then secured to the fabric strip 34. This can be done either with an adhesive or by a line of stitching as desired. By this arrangement, the edge 46 of the fur strip is entirely defined by fur and provides a smooth attractive appearance with the seam between the fur and the hook strip concealed from view and contact with the user. At the same time a substantial portion of the hook strip is exposed to view for contact with the loop strip, as described hereinafter.

In addition to the strips 36, 40, additional hook and loop strips 47, 48 are provided. As seen in FIG. 2, the loop strip 48 is positioned at the end 26 of the fur strip with the loops facing in the same direction as the leather side of the fur. The hook strip 47 is secured at one end 50 thereof to the backing strip 34 and has a free end 52. In this case, the hook strip 46 is secured so that the hooks face in the same direction as the fur strip. The strips 47, 48 serve to connect the ends of the fur strip together to define a head band as described hereinafter.

Figure 4:
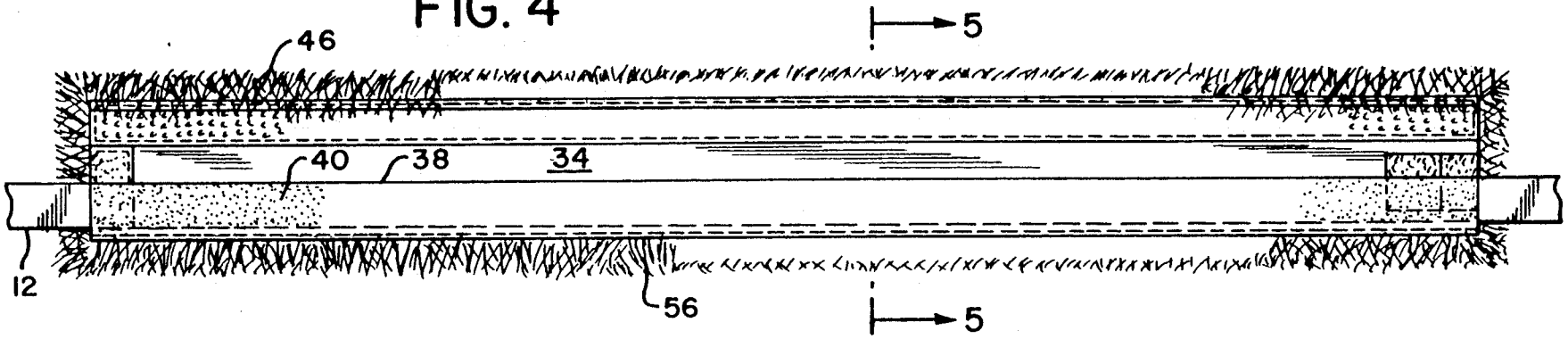
FIG. 4 is a rear plan view similar to FIG. 2 showing the process of converting the fur strip to a tube for surrounding the strap of a handbag with a light.
Figure 6:
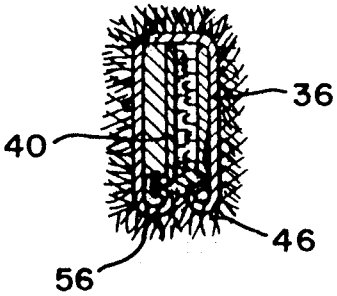
FIG. 6 is a sectional view, similar to FIG. 5, showing the fur strip folded over to form the tube.
Figure 5:
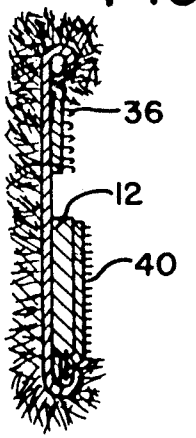
FIG. 5 is a sectional view, taken along line 5—5 of FIG. 4.

In order to use the convertible fur strip 10 of the present invention as a guard for a shoulder bag strap, the strap 12 is positioned against the backing strip 34 of the fur piece, as seen in FIG. 4, and the loop strip 40 is folded over the shoulder bag strap. When the loop strip is folded over in this manner, the edge 56 of the fur strip is formed entirely of fur, in the same manner as described above with respect to the edge 46, in order to provide a pleasing appearance and to conceal the seam between the fur and the strip 40. At the same time, the tab 47 of hook material is folded inwardly beneath the strap 12 so that it is concealed from view. With the convertible fur strip arranged in this manner, the fur strip can now be folded substantially in half in order to bring the hook strip 36 into contact with the loop strip 40, as seen in FIG. 6. The hooks of the strip 36 will engage the loops of the strip 40 and hold the ends of the fur strips together to form a tube, as seen in FIG. 6, which contains the strap 12. The strap 12 is free to slide within the tube. However, the tube gives the appearance of a substantially continuous hollow tube and forms a pleasing decorative appearance on the shoulder strap. This serves as a decorative element and as a protector, as described above.

In order to remove the convertible fur strip from the shoulder strap, the process described above is reversed. The edges 56, 46 of the fur strip are peeled away from each other to release the hook and loop connections and the strap is removed.

In order to use the convertible fur strip of the present invention as a head band, the hook strip 47 is extended to the position shown in FIG. 2 so that it is free and is away from the edge 28 of the fur strip. The loop strip 40 is then folded over towards the leather side of the fur strip, into the position shown in FIG. 4. The loop strip has a relatively smooth feel to the touch, and only a portion of the hook strip is exposed along the edges of the fur. The band can then be placed in this configuration about the forehead of the wearer, as seen in FIG. 8. The hooks of strip 47 are then engaged with the loops and the strip 26 to secure the head band to the wearer. Because the hooks on the strip 36 are partially protected by the fur and because the loops on the strip 40 are soft to the touch, the head band is comfortable to wear.

Accordingly, it is seen that a relatively simply constructed convertible fur piece is provided which will enable the user to have a single decorative element that can be used for two separate fashion purposes, either as a decorative element for a handbag or as a head band. In addition, the fur piece serves as a protective element for fur garments when used on the shoulder strap of a handbag.

Although an illustrative embodiment of the present invention has been described herein with reference to the accompanying drawings, it is to be understood that various changes and modifications can be effective therein by one skilled in the art without departing from the scope and spirit of this invention.

What is claimed is:

1. A convertible fur piece comprising an elongated strip of fur having opposed generally parallel longitudinal edges, means on said edges for releasably securing the longitudinal edges of the elongated fur strip together to define an open ended tube means for receiving a handbag strip or the like therein.

2. A convertible fur piece as defined in claim 1, wherein said fur strip has opposed end portions, and means on said end portions for selectively connecting the end portions together to form a head band.

3. A convertible fur piece as defined in claim 1, wherein said releasable securing means comprises elongated strips of loop and hook connecting means respectively connected to said longitudinal edges of the fur piece.

4. A convertible fur piece as defined in claim 3, wherein said strip of fur has a fur side and an opposed leather side, and said hook strip is sewn along one edge of the hook strip, to one of the longitudinal edges of the fur strip with the hooks thereon facing the fur side of the fur strip, said hook strip being folded over against the leather side of the fur strip and having the other edge of the hook strip sewn to the leather side of the fur strip.

5. A convertible fur piece as defined in claim 4, wherein the loop strip has a pair of longitudinal edges with one of the edges of the loop strip being sewn to the other longitudinal edge of the fur strip with the loops facing in the same direction as the fur, the other edge of the loop strip being free whereby the loop strip can be folded towards and away from the leather side of the fur.

6. A convertible fur piece as defined in claim 5, wherein said fur strip has opposed end portions and means on said end portions for selectively connecting the end portions together to form a head band.

7. A convertible fur piece as defined in claim 6, wherein said means for selectively connecting the end portions together comprises hook and loop connecting means.

8. A convertible fur piece comprising an elongated strip of fur having a fur side and a leather side, a pair of longitudinally extending elongated edge portions and a pair of opposed end portions, means on said elongated edge portions of the fur strip for releasably securing said edges together to define an open-ended elongated fur tube means for receiving a handbag strap or the like.

9. A convertible fur piece as defined in claim 8, including releasable connecting means on said end portions of the fur strip for selectively connecting the end portions together to form a fur head band when the longitudinal edges of the fur strip are not secured together.

10. A convertible fur piece as defined in claim 8, wherein said means for releasably securing said edges together comprise elongated strips of loop and hook connecting means respectively secured to said longitudinally extending edge portions of the fur strip.

11. A convertible fur piece as defined in claim 10, wherein said loop and hook connecting means comprises a first strip of fabric having hooks formed on one side thereof and including a longitudinally extending edge blind-stitched to one longitudinal edge of the fur strip and a second strip of fabric having loops formed on one side thereof and including a longitudinally extending edge blind-stitched to the other longitudinal edge of the fur strip, said first and second fabric strips being sewn along said edges with the loop and hook sides thereof facing in the same direction as the fur side of the fur strip.

12. A convertible fur piece as defined in claim 11, including a fabric backing strip secured to the leather side of the fur strip.

13. A convertible fur piece as defined in claim 12, wherein said first strip of fabric having hooks formed therein is folded over said fabric backing strip and is secured thereto whereby the seam between the first fabric strip and the fur strip is concealed.

14. A convertible fur piece as defined in claim 13, wherein said second strip of fabric having loops formed thereon includes a second longitudinal edge which is free and folded over the leather side of the fur strip to conceal a strap or the like between it and the fabric backing strip, said fur strip being foldable in half about its length to cause the loop and hook strips to engage and secure the edges of the fur strip together to define an open ended tube.

15. A convertible fur piece as defined in claim 14, including releasable connecting means on said end portions of the fur strip for selectively connecting the end portions together to form a fur head band when the longitudinal edges of the fur strip are not secured together.

16. A convertible fur piece as defined in claim 15, wherein said means for releasably securing said edges together comprise elongated strips of loop and hook connecting means respectively secured to said longitudinally extending edge portions of the fur strip.

* * * * *